US008123914B2

(12) United States Patent
Hitomi

(10) Patent No.: US 8,123,914 B2
(45) Date of Patent: Feb. 28, 2012

(54) ELECTRODE PLATE TRANSPORTATION APPARATUS

(75) Inventor: Takahisa Hitomi, Hitachi (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 539 days.

(21) Appl. No.: 12/412,239

(22) Filed: Mar. 26, 2009

(65) Prior Publication Data

US 2009/0242390 A1 Oct. 1, 2009

(30) Foreign Application Priority Data

Mar. 26, 2008 (JP) ..... 2008-081780

(51) Int. Cl.
*C25D 17/00* (2006.01)

(52) U.S. Cl. ..... 204/198
(58) Field of Classification Search ..... 204/198, 204/286.1
See application file for complete search history.

(56) References Cited

U.S. PATENT DOCUMENTS

| | | | |
|---|---|---|---|
| 4,028,211 | A | 6/1977 | Hirakawa et al. |
| 4,894,129 | A | 1/1990 | Leiponen et al. |
| 5,762,767 | A | 6/1998 | Yamada et al. |

FOREIGN PATENT DOCUMENTS

| | | | |
|---|---|---|---|
| CL | 37132 | | 1/1990 |
| CL | 02768-2002 | | 12/2002 |
| CN | 2704593 | Y | 6/2005 |
| JP | 55-36277 | B2 | 9/1980 |
| JP | 3-56688 | A | 3/1991 |
| JP | 8-13181 | A | 1/1996 |
| JP | 8-175659 | A | 7/1996 |
| JP | 2000-345378 | A | 12/2000 |
| JP | 3579802 | B2 | 7/2004 |

OTHER PUBLICATIONS

Office Action dated Feb. 24, 2011 for corresponding Chinese Application No. 200810171004.0.
Japanese Office Action issued Apr. 6, 2010 in corresponding Japanese patent application No. 2008-081780 (with English translation).
Chilean Office Action, dated May 31, 2011, for Chilean Application No. 751-09.

*Primary Examiner* — Luan Van
(74) *Attorney, Agent, or Firm* — Birch, Stewart, Kolasch & Birch, LLP

(57) ABSTRACT

An electrode plate transportation apparatus moves up and down electrode plates moved to a position above an electrolytic bath, and places and draw the electrode plates in and from the electrolytic bath. The apparatus includes a stationary frame that is suspended from an upper position in a vertical direction, a rotary unit that is composed of hold members for holding the electrode plates in a suspended state and is held so as to rotate in a rotational direction about the vertical direction by the stationary frame, and a drive mechanism that is provided between the stationary frame and the rotary unit and applies drive force along an one-axis direction in a plane perpendicular to the vertical direction to the rotary unit to thus drive the rotary unit in the rotational direction.

9 Claims, 9 Drawing Sheets

ELECTRODE PLATE TRANSPORTATION APPARATUS

FIELD

The present invention generally relates to an electrode plate transportation apparatus, and more particularly, to an electrode plate transportation apparatus in which many electrode plates are horizontally moved to a position above an electrolytic bath and lifting and lowering the electrode plates so that the electrode plates can be placed in and drawn from the electrolytic bath.

BACKGROUND

Conventional electrolytic refining of nonferrous metal such as copper or zinc alternately arranges anode plates and cathode plates (electrode plates) in an electrolytic bath having an aqueous solution of salt of a target metal. The electrode plates are energized for a predetermined time, and are lifted to leave the electrolytic bath. The electrolytic refining may be implemented by an electrode plate transportation apparatus. This apparatus is capable of horizontally moving the electrode plates in a suspended state to the position above the electrolytic bath. Further, the electrode plate transportation apparatus is capable of lifting and lowering the electrode plates after the horizontal transportation, so that the electrode plates can be placed in and drawn from the electrolytic bath.

The electrode plate transportation apparatus has multiple holding members (hooks) arranged in parallel. The hooks hold the electrode plates in the suspended state. This kind of apparatus is described in, for example, Japanese Examined Patent Application Publication No. 55-36277 (Document 1) or Japanese Patent No. 3579802 (Document 2).

An electrode plate transportation apparatus described in Document 1 (named automatic electrode plate replacement apparatus in Document 1) has rails provided at opposite sides of the electrolytic bath. The electrode plates may be moved along the rails and may be stopped. The apparatus is equipped with an electrode plate suspending platform capable of moving up and down. An electrode plate transportation apparatus described in Document 2 has a mechanism for placing and drawing the suspended cathode plates in and from the electrolytic bath, in which the mechanism can move along a guide rail.

In the suspended type apparatus as described in Document 2, a shock may occur when the electrode plates (cathode plates) shifts to the stationary state from the moving state, and the cathode plates may swing greatly. Document 2 proposes to use a swing blocking bar for mechanically preventing the cathode plates from swing.

However, the mechanical blocking may deform the electrode plates and may cause faulty electrodeposition due to deformation of the electrode plates.

When wires are used to suspend the electrode plates, the electrode plates may lose balance. This may cause the member for holding the electrode plates to be horizontally rotated and may make it difficult place the electrode plates in the electrolytic bath.

SUMMARY

The invention has been made in view of the above circumstance and provides an electrode plate transportation apparatus capable of restraining swinging of electrode plates and changing the attitudes of the electrode plates.

According to an aspect of the present invention, there is provided an electrode plate transportation apparatus that lifts and lowers electrode plates moved to a position above an electrolytic bath and places and draw the electrode plates in and from the electrolytic bath, including: a stationary frame that is suspended from an upper position in a vertical direction; a rotary unit that is composed of hold members for holding the electrode plates in a suspended state and is held so as to rotate in a rotational direction about the vertical direction by the stationary frame; and a drive mechanism that is provided between the stationary frame and the rotary unit and applies drive force along an one-axis direction in a plane perpendicular to the vertical direction to the rotary unit to thus drive the rotary unit in the rotational direction.

The electrode plate transportation apparatus may be configured so that the rotary unit includes: a rotary frame that is provided above the stationary frame and is rotated about the vertical direction in response to the drive force by the drive mechanism; a base frame that is provided below the stationary frame and supports the hold members; and joint members that join the rotary frame and the base frame.

The electrode plate transportation apparatus may further include: a motor attached to the stationary frame; a screw that is attached to a rotary shaft and extends in the one-axis direction; a nut engaged with the screw; and a transfer member that transfers driving force of the nut that is moved along the rotary shaft of the motor by rotation of the screw to a position that is offset from a center of gravity of the rotary unit in the plane in a direction crossing the one-axis direction.

The electrode plate transportation apparatus may further include an overload protection mechanism that prevents driving force of the motor from being transferred to the screw when a load exceeding a threshold level is applied.

The electrode plate transportation apparatus may further include another driving mechanism that is paired with said driving mechanism and is symmetrical with said driving mechanism about a center of gravity of the stationary frame, wherein said another driving mechanism has a configuration identical to that of said driving mechanism.

The electrode plate transportation apparatus may further include a guide mechanism that is provided between the stationary frame and the rotary unit and guides the rotary unit in the rotational direction about the vertical direction.

The electrode plate transportation apparatus may be configured so that the guide mechanism includes: a guide member that is fixed to the stationary frame and is formed in an arc shape; and a slider member that is fixed to the rotary unit and slide on the guide member.

The electrode plate transportation apparatus may be configured so that the guide mechanism has a stopper that limits a range of movement of the slider member.

The electrode plate transportation apparatus as claimed in claim 1, may further include: a detecting part that detects a relative angle between the rotary unit and the electrolytic bath; and a drive control part that controls the drive mechanism on the basis of the relative angle detected by the detecting part to thus drive the rotary unit in the rotational direction.

The electrode plate transportation apparatus may be configured so that the detecting part includes: a marker that indicates an angle of the electrolytic bath; an image taking part that is attached to the rotary unit and takes an image of the marker; and a calculation part that calculates the relative angle on the basis of the image of the maker taken by the image taking part.

DETAILED DESCRIPTION

Figure 1:
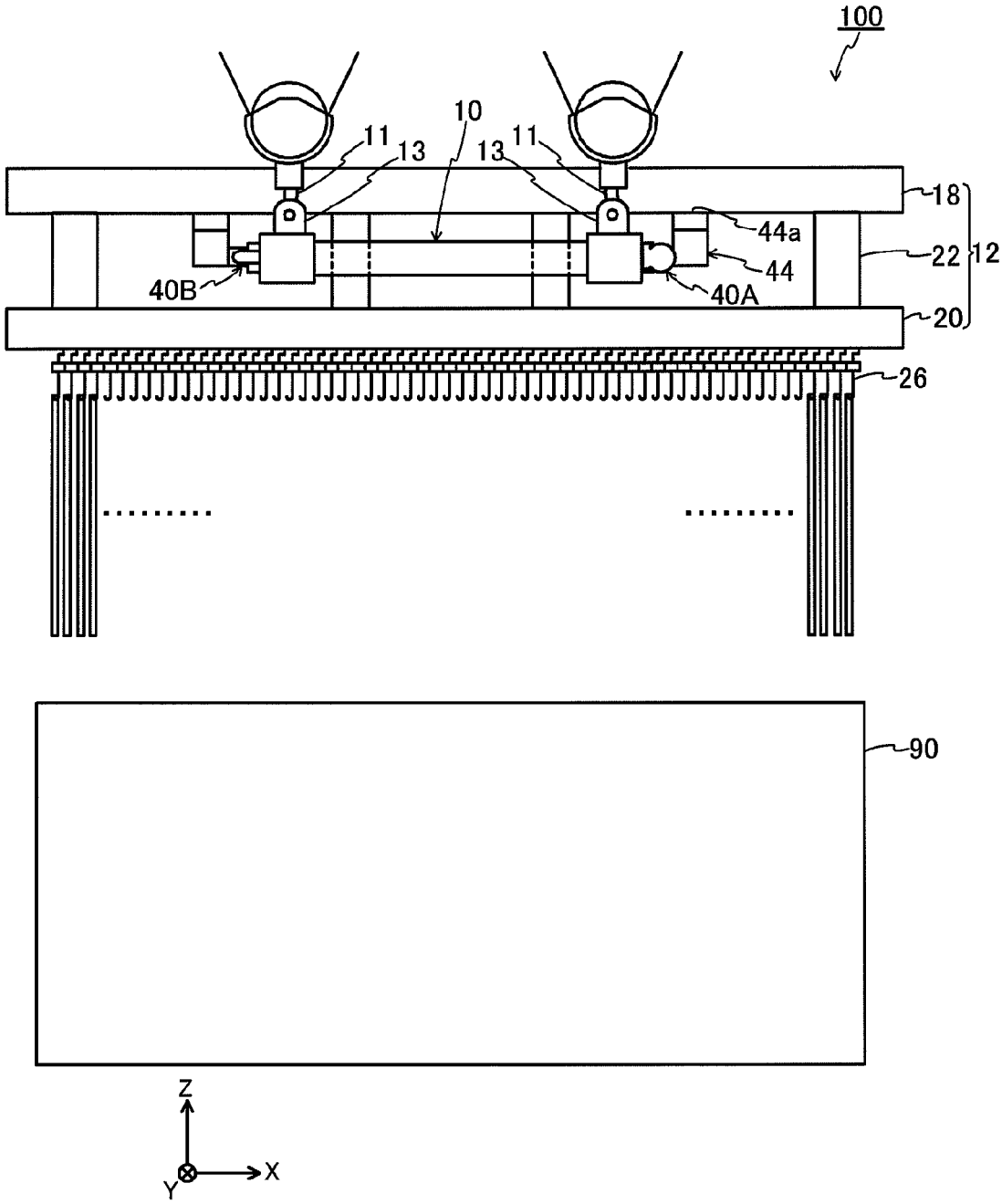
FIG. 1 schematically illustrates an electrode plate transportation apparatus in accordance with a first embodiment of the present invention.

A description is now given of embodiments of the present invention with reference to the accompanying drawings.

First Embodiment

FIGS. 1 through 5 illustrate an electrode plate transportation apparatus in accordance with a first embodiment. In the following description, for the convenience sake, an X direction is defined as a horizontal direction on the drawing sheets, and a Y direction is defined as a direction perpendicular to the drawing sheets, while a Z direction is defined as a vertical direction on the drawing sheets.

Referring to FIG. 1, an electrode plate transportation apparatus 100 in accordance with the first embodiment is equipped with a stationary frame 10, that is held in a suspended state by a ceiling travel crane (not shown), and a rotary unit 12 that is rotatably held about the vertical direction (the Z-axis direction) with respect to the stationary frame 10. The center of gravity of the stationary frame 10 and that of the rotary unit 12 coincide with each other (see symbol G in FIG. 2).

Figure 2:
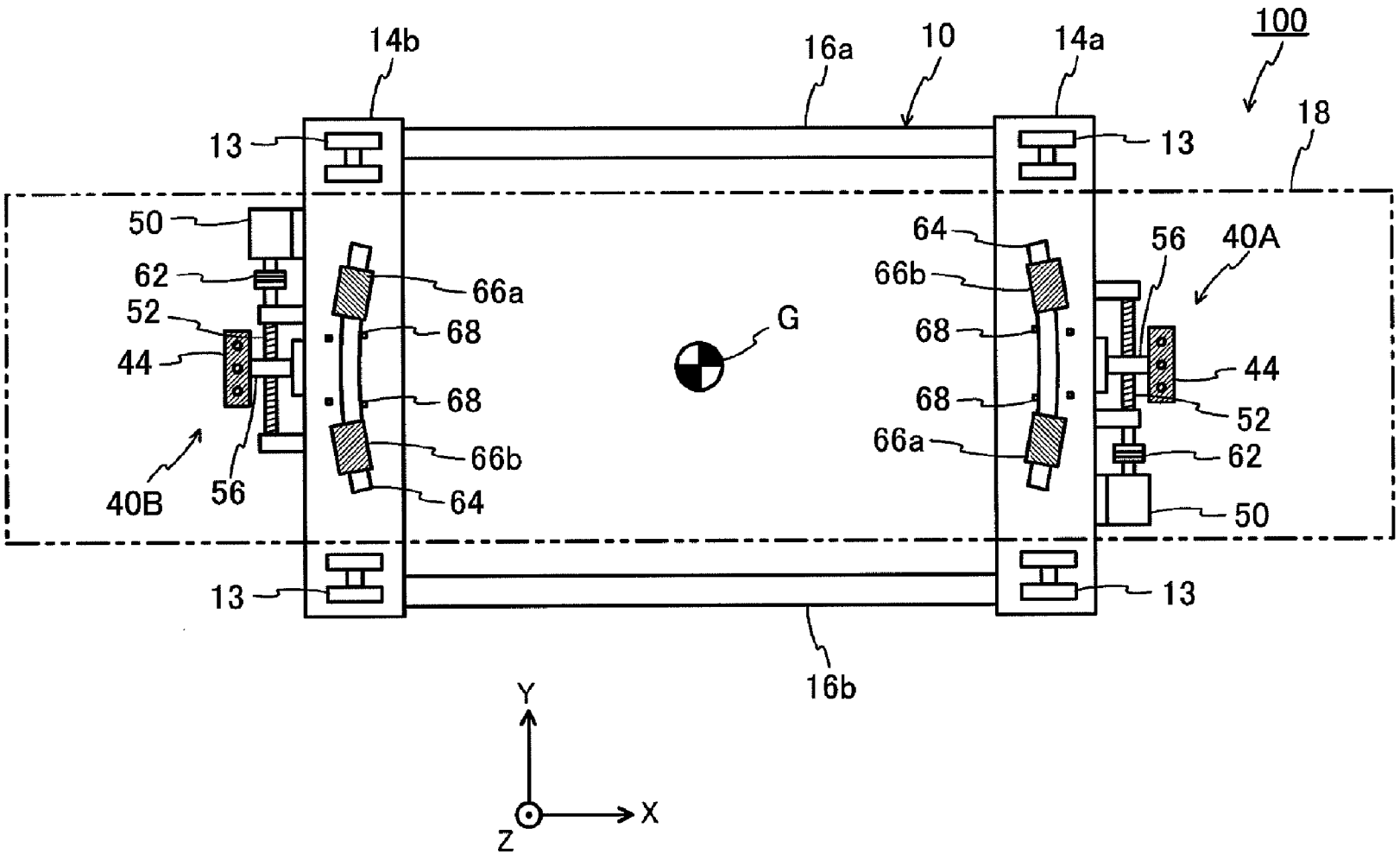
FIG. 2 is a plan view of a stationary frame and a rotation drive mechanism of the electrode plate transportation apparatus illustrated in FIG. 1.
Figure 3:
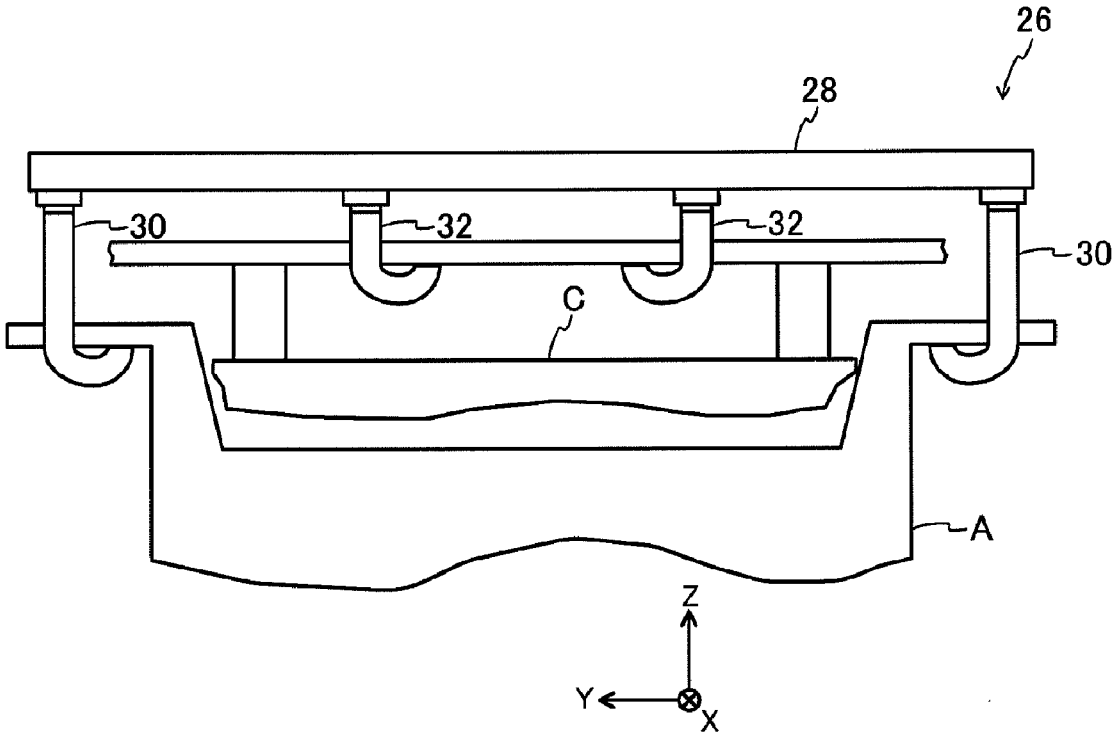
FIG. 3 is a view of hangers illustrated in FIG. 1 viewed from an X direction.

As illustrated in FIG. 2, the stationary frame 10 has a pair of first beams 14*a*, 14*b* running in the Y-axis direction, and a pair of second beams 16*a* and 16*b* running in the X-axis direction. The stationary frame 10 has a rectangular shape as a whole. Two engagement portions 13 are provided on the upper surface of each of the first beams 14*a* and 14*b*. Hooks 11 of the ceiling travel crane are engaged with the engagement portions 13, so that the stationary frame 10 can be suspended.

As illustrated in FIG. 1, the rotary unit 12 has a rotary frame 18, a base frame 20, and multiple joint members (steel members) 22. The rotary frame 18 is provided above the stationary frame 10. The base frame 20 is provided below the stationary frame 10. The multiple joint members 22 join the rotary frame 18 and the base frame 20.

The rotary frame 18 has a member of a rectangular plate having the longitudinal sides running in the X-axis direction, and is supported by the stationary frame 10 from the lower side of the rotary frame 18 so that the rotary frame 18 can be rotated about the Z axis with respect to the stationary frame 10.

The base frame 20 includes a pair of main beams running in the X-axis direction, and multiple sub beams that join the pair of main beams at multiple positions and run in the Y-axis direction. These beams are not illustrated for the sake of simplicity. There are many hangers 26 (for example, 50 to 60 hungers) attached to the lower side of the base frame 20 and used for holding the electrode plates in the suspended state. As can be seen from FIG. 3 in which the hangers 26 are viewed from the −X side, each of the hangers 26 has a hook hold member 28, a pair of hooks 30 for suspending an anode plate A, and a pair of hooks 32 for suspending a cathode plate C. The hook hold member 28 runs in the Y-axis direction. The two hooks 30 are respectively provided on opposite ends of the hook hold member 28 in the Y-axis direction. The hooks 32 are provided further in than the hooks 30. The pair of hooks 30 holds the anode plate A in the suspended state, and the pair of hooks 32 holds the cathode plate C in the suspended state. The hooks 30 and 32 are allowed to rotate about the Z axis by a driving mechanism (not illustrated). By rotating the hooks 30 and 32, the hooks 30 may be engaged with and disengaged with the anode plate A, and the hooks 32 may be engaged with and disengaged with the cathode plate C.

Turing to FIG. 1 again, there are rotation drive mechanism 40A and 40B between the stationary frame 10 and the rotary frame 18. These mechanisms 40A and 40B rotate the rotary unit 12 with respect to the stationary frame 10.

Figure 4:
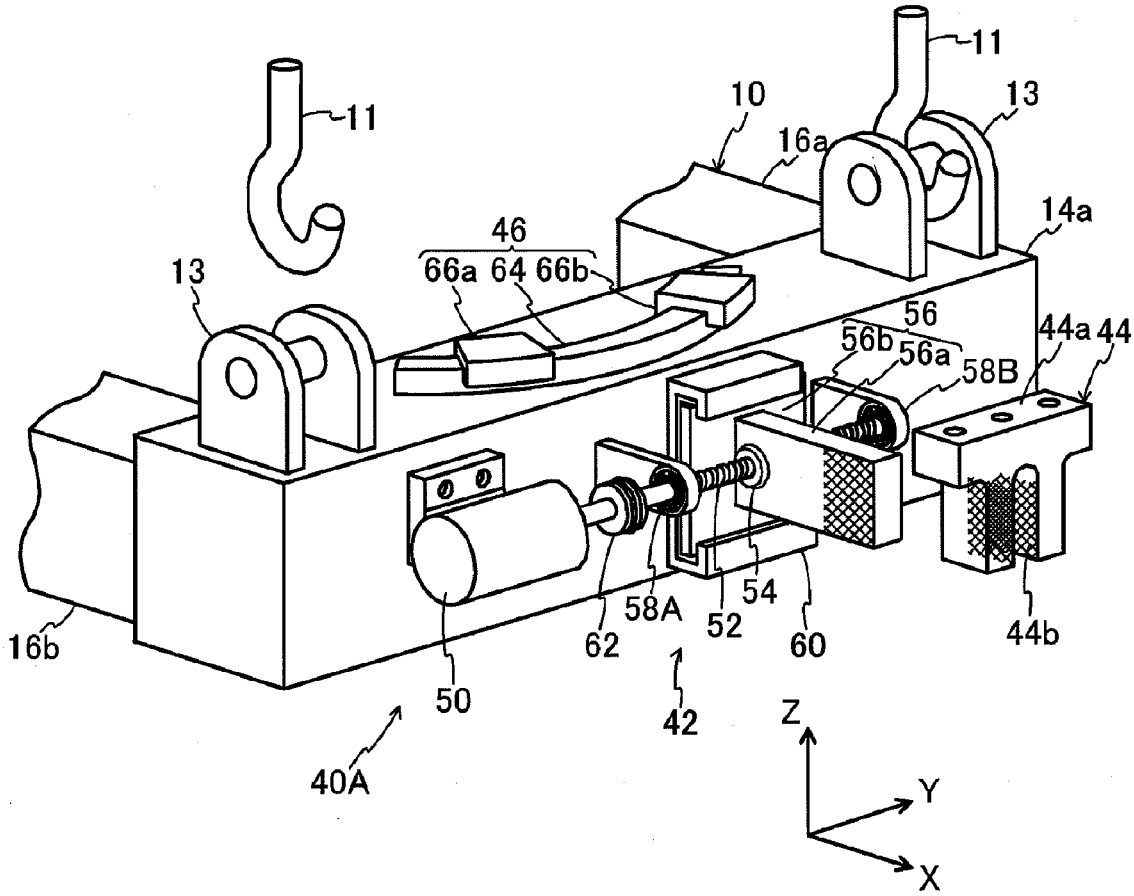
FIG. 4 is a perspective view of a rotation drive mechanism 40A.

As illustrated in the perspective view of FIG. 4, the rotation drive mechanism 40A is equipped with a linear drive mechanism 42, a transfer member 44, and a guide mechanism 46. The linear drive mechanism 42 is mounted on the surface of the stationary frame 10 on its +X side (more particularly, the first beam 14*a*). The transfer member 44 transfers the driving force of the linear drive mechanism 42 to the rotary frame 18. The guide mechanism 46 guides the rotary frame 18 in the rotational direction about the Z axis.

The linear drive mechanism 42 has a drive motor 50, a screw 52, a nut 54 and a T-shaped moving member 56. The screw 52 may be a trapezoidal screw connected to the rotary shaft of the drive motor 50. The nut 54 may be a trapezoidal nut that is penetrated through the moving member 56 and is screwed onto the screw 52. The moving member 56 is fixed to the nut 54 so as to form a single piece and has a T shape viewed from the +Z direction.

The drive motor 40 generates rotating force about the Y axis, and is fixed to the stationary frame 10 (more specifically, the first beam 14*a*) by screws. The drive motor 50 is connected to a motor control circuit (not illustrated). An input or man-machine interface such as a joystick is connected to the motor control circuit, which controls the rotation of the drive motor 50 in accordance with an instruction from the operator applied via the input interface.

The ends of the screw 52 are held by a pair of hold members 58A and 58B fixed to the stationary frame 10 by welding. The hold members 58A and 58B are provided with ball bearings into which the screw 52 is inserted. Thus, the screw 52 is allowed to rotate about the Y axis. The screw 52 is rotated by the rotating force of the drive motor 50. The nut 54 engaged with the screw 52 may be moved in the +Y or −Y direction based on the rotating direction and speed of the screw 52. The screw 52 and the nut 54 form a feed screw mechanism.

As illustrated in FIG. 4, an overload protection mechanism (torque limiter) 62 is provided between the drive motor 50 and the screw 52. The torque limiter 62 prevents the rotating force of the drive motor 50 from being transferred to the screw 52 when a load that exceeds a threshold level is applied on the drive motor 50.

The moving member 56 has a first plate member 56*a* and a second plate member 56*b*. The second plate member 56*b* is engaged with a guide member 60, which is welded to the stationary frame 10 and is formed into a C-shape viewed from the −Y axis. The second plate member 56*b* is an un-refuel slide plate and is slidable along the guide member 60 in the Y-axis direction.

In the linear drive mechanism 42 thus configured, the motor control circuit adjusts the rotating direction and revolution of the drive motor 50, so that the moving member can slide in the Y-axis direction.

As illustrated in FIG. 4, the transfer member 44 has an about π shape, and engages a +X-side end of the moving member 56 (first plate member) in a recess 44*b* defined by arm-shaped portions formed in the lower side of the transfer member 44. In FIG. 4, the transfer member 44 and the moving member 56 are separate from each other for the convenience's sake. The transfer member 44 and the first plate member 56*a* are not fixedly attached to each other. Thus, the transfer member 44 can slide on the first plate member 56*a* in the X-axis direction. In other words, the transfer member 44 can change the relative position in the X-axis direction. The distance between the two arms of the lower portion of the transfer member 44 in the Y-axis direction is set slightly greater than the width of the first plate member 56*a* in the Y-axis direction.

As illustrated in FIG. 1, the transfer member 44 of the rotation drive mechanism 40A has an upper surface 44*a* fixed to the lower surface of the rotary frame 18 by screws. Thus, as illustrated in FIG. 5, the driving force F1 in the Y-axis direction generated by the motors 50 of the rotation drive mechanism 40A is transferred, via the transfer member 44, to a position that is offset from the center of gravity G of the rotary frame 18 in the +X direction.

Turning back to FIG. 4, the guide mechanism 46 has a guide member 64, and a pair of slider members 66*a* and 66*b*. The guide member 64 is fixed to the upper surface of the first beam 14*a* of the stationary frame 10 and has an arc shape. The slider members 66*a* and 66*b* are slidable on the guide member 64. The upper surfaces of the slider members 66*a* and 66*b* are fixed to the lower surface of the rotary frame 18. In the first embodiment, as illustrated in FIG. 5, the guide mechanism 46 changes the driving force (F1) transferred to the rotary frame 18 from the linear drive mechanism 42 to driving force (F2) in the rotating direction about the Z axis.

As depicted in FIG. 2, the other rotation drive mechanism 40B is structurally the same as the rotation drive mechanism 40A and is symmetrical with the rotation drive mechanism 40A about the center of gravity G of the stationary frame 10. Thus, in the following, the structural elements of the rotation drive mechanism 40B will be described with the same reference numerals as those of the structural elements of the rotation drive mechanism 40A.

Figure 5:
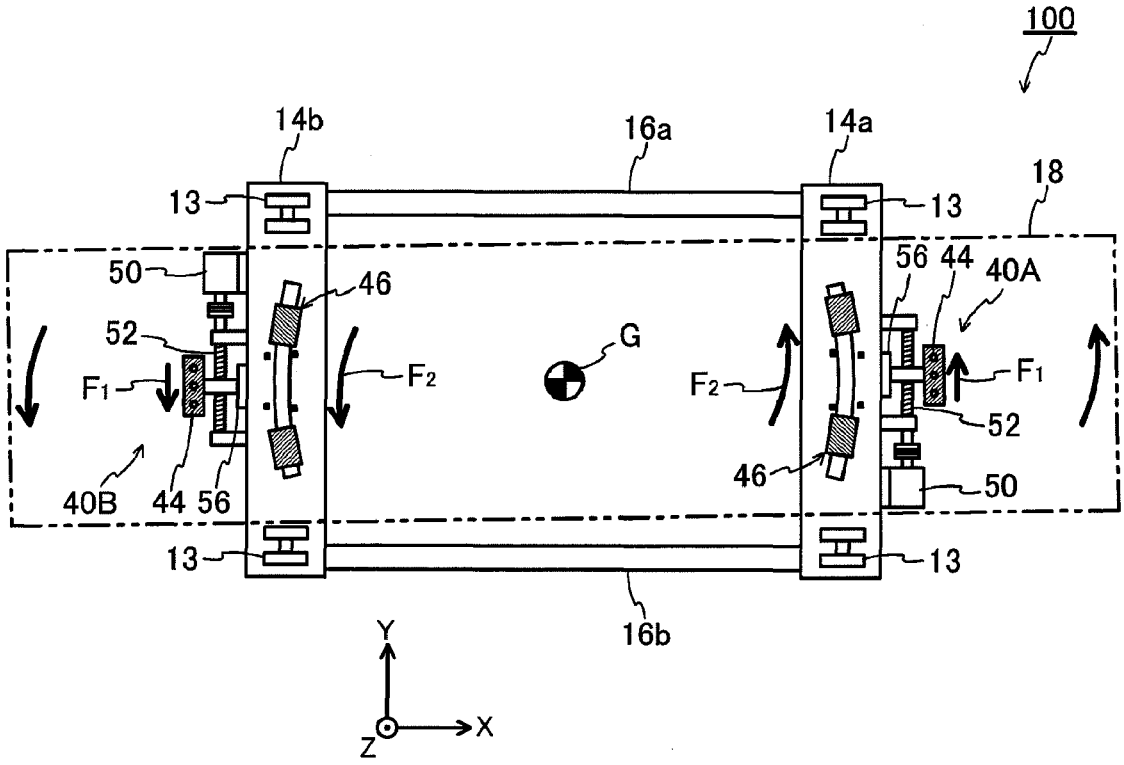
FIG. 5 illustrates the electrode plate transportation apparatus in which a rotary unit is slightly rotated from the state depicted in FIG. 2.

When identical currents are supplied to the drive motors 50 of the rotation drive mechanisms 40A and 40B, the respective driving forces F2 illustrated in FIG. 5 are exerted on positions that are symmetrical about the center of gravity G. Thus, the rotary unit 12 (more specifically, the base frame 20) are slightly rotated about the Z axis located at the center of gravity G. The range of slight rotation may be set approximately equal to the range of vibration of the stationary frame 10 or the range of variation of the attitude of the stationary frame 10. For example, the range of slight rotation may be set equal to 3 degrees ranging between 1.5 degrees in the counterclockwise direction from the neutral position and 1.5 degrees in the clockwise direction therefrom. In the present embodiment, the range of slight rotation may be defined by stoppers 68 that limit the movements of the slider members 66*a* and 66*b*. The stopper members 68 may be pin-like members, which may be driven to the upper surface of the stationary frame 10, more specifically, the upper surfaces of the first beams 14*a* and 14*b*.

Referring to FIG. 1, in the electrode plate transportation apparatus 100 configured as described above in accordance with the first embodiment, the cathode plates C that are held in the suspended state by the hangers 26 are moved to the position above an electrolytic bath 90 by the ceiling travel crane (not illustrated). At this time, the anode electrodes A are already placed and arranged in an electrolytic bath 90. After the cathode plates C are positioned, the ceiling travel crane lowers the entire electrode plate transportation apparatus 100 into the electrolytic bath 90 so that the cathode electrodes C and the anode electrodes A can be interleaved. When the electrode plate transportation apparatus 100 is placed (stopped) above the electrolytic bath 90, reaction force caused by stoppage may rotate the entire apparatus 100 about the Z axis, or unbalance of holding the stationary frame 10 by the ceiling travel crane may vary the horizontal attitude of the stationary frame 10.

The present embodiment is capable of restraining swing and/or attitude variation of the electrode plate transportation apparatus 100. For example, the operator visually confirms swing and/or attitude variation of the electrode plate transportation apparatus 100, and manipulates the input interface (such as a joystick) in directions opposite to the directions in which the apparatus 100 swings and varies in attitude so as to cancel swing and/or attitude variation. The instructions given by the operator via the input interface are processed by the motor control circuit, which slightly rotates the rotary unit 12 (more specifically, the base frame 20) to restrain swing and/or attitude variation.

Our experiments and computer simulation show the following. In the conventional mechanism without the rotary unit 12, the electrode plates swing in a range of 50 mm when the electrode plate transportation apparatus is stopped. In contrast, the present embodiment has a reduced swing range of 10 mm or less due to the presence of the rotary unit 12 that is slightly rotated with respect to the stationary frame 10. It is to be noted that the cathode plates C are allowed to be placed in spaces defined by the adjacent anode plates A after the swing of the cathode plates C is manually stopped. In contrast, according to the present embodiment, the cathode plates C may be placed in spaces without manually stopping the swing of the cathode plates C. Even when the cathode plates C vary in the horizontal attitude, this variation can easily be removed by slightly rotating the rotary unit 12. It is thus possible to easily position the cathode plates C in place.

According to the first embodiment, the rotary unit 12 having the hangers 26 for holding the cathode electrodes C in the suspended state is held so as to rotate about the vertical direction (the Z axis) with respect to the stationary frame 10. The rotation drive mechanisms 40A and 40B provided between the stationary frame 10 and the rotary unit 12, in other words, the linear drive mechanisms 42 apply the driving forces to the rotary unit 12 in the Y-axis direction to thus rotate the rotary unit 12 slightly. Thus, even when the stationary frame 10 vibrates, the rotary unit 12 is slightly rotated to correct the attitudes (directions) of the electrode plates easily. It is thus possible to easily place the cathode plates C in position so that the cathode plates C and the anode plates A can be interleaved. Further, even if the attitude of the stationary frame 10 in the horizontal plane varies, the rotary unit 12 is slightly rotated to correct the positions and attitudes of the cathode plates C. It is easy to place and draw the cathode electrodes in and from the electrolytic bath 90.

In the first embodiment, the rotary frame 18 that is slightly rotatable to the stationary frame 10 is arranged above the stationary frame 10, and the base frame 20 is arranged below the stationary frame 10. It is thus possible to coincide the center of gravity of the stationary frame 10 with the center of gravity of the rotary unit 12 including the rotary frame 18 and the base frame 20. With this structure, it is possible to realize good weight balance between the stationary frame 10 and the rotary unit 12.

In the first embodiment, the linear driving forces in the longitudinal direction (Y-axis direction) of the screws 52 generated by the rotation drive mechanisms 40A and 40B are transferred, via the transfer members 44, to the positions that are offset in the X direction from the center of gravity G of the rotary unit 12. With this simple structure, the rotary unit 12 can be rotated in the horizontal plane (XY plane). In this case, the engagements of the transfer members 44 and the first plate members 56*a* do not prevent the rotating operation of the rotary unit 12. This is because the transfer members 44 are slidable in the X-axis direction with respect to the first plate members 56*a* to change the relative position in the X-axis direction, and the widths of the recesses 44*b* of the transfer members 44 in the Y direction are slightly greater than the widths of the first plate members 56*a* in the Y direction.

The first embodiment is equipped with the torque limiters 62 that prevent the rotating forces of the drive motors 50 from being transferred to the screws 52 when a torque greater than the threshold level is applied to the motors 50. It is thus possible to prevent the rotation drive mechanisms 40A and 40B from being damaged due to overload.

In the first embodiment, the single pair of rotation drive mechanisms 40A and 40B are symmetrical about the center of gravity G of the stationary frame 10. When the mechanisms 40A and 40B generate identical driving forces, the rotary unit 12 can be rotated about the center of gravity G of the stationary frame 10. The guide mechanisms 46 function to reliably rotate the rotary unit 12 about the Z axis.

In the first embodiment, the stopper members 68 for limiting the movements of the slider members 66*a* and 66*b* are provided in the vicinity of the guide members 64. It is thus possible to prevent excessive rotation of the rotary unit 12.

The first embodiment may be varied so that one of the pair of rotation drive mechanisms 40A and 40B is omitted. One of the linear drive mechanisms 42 of the rotation drive mechanisms 40A and 40B may be omitted. The first embodiment may be varied so that the stopper members 68 are replaced with different stopper members that are ached to the screws 52 and limit the moving ranges of the nuts 54.

Second Embodiment

A description is now given, with reference to FIGS. 6 through 9, of a second embodiment of the present invention. The second embodiment differs from the first embodiment in that the rotary unit 12 is automatically driven to rotate. Thus, the following description will focus upon the above difference, and the same structural elements of the second embodiment as corresponding elements of the first embodiment will not be described here.

Figure 6:
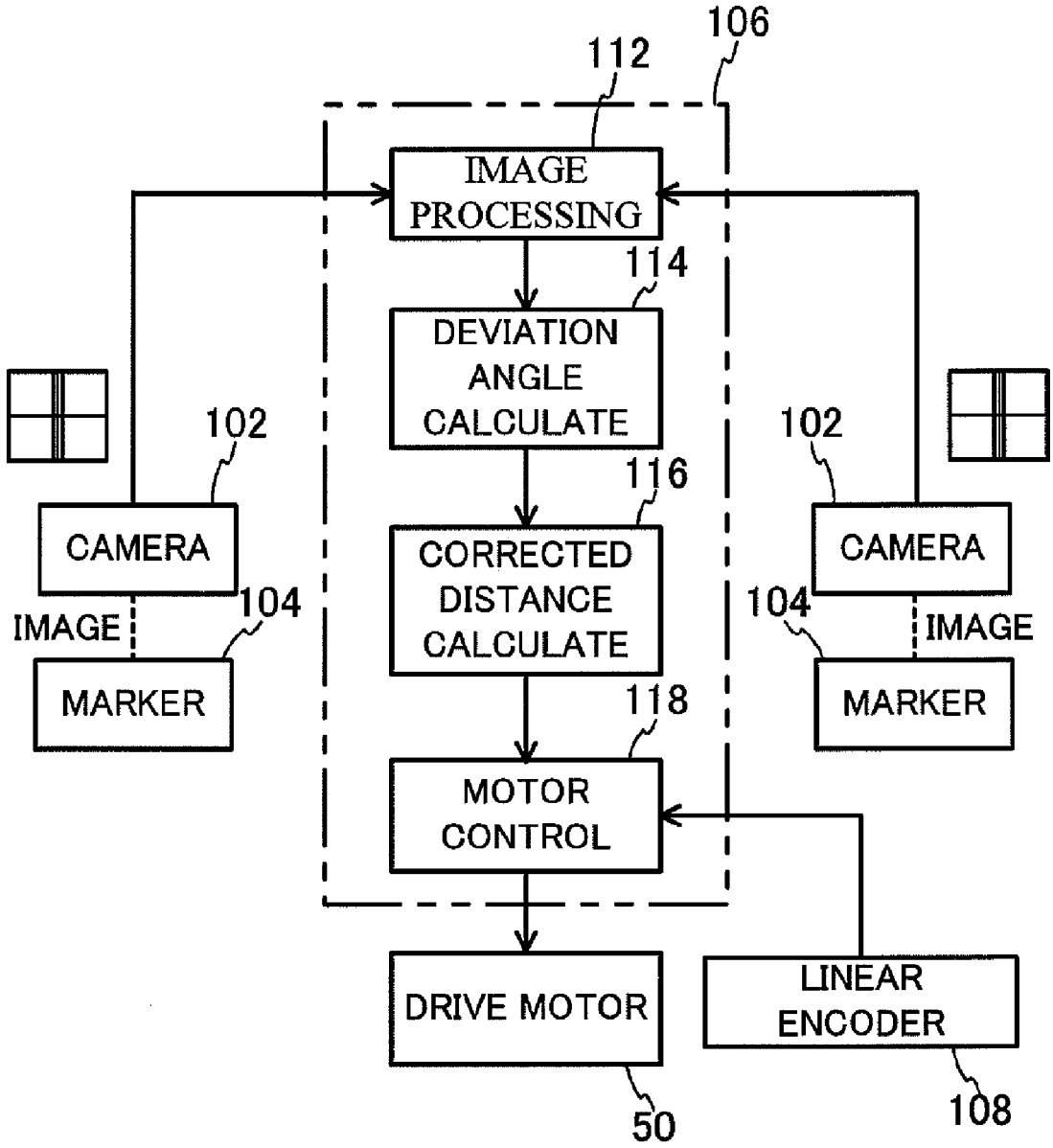
FIG. 6 is a block diagram of a control system in accordance with a second embodiment.

FIG. 6 is a block diagram of a control system that realizes automatic control in accordance with the second embodiment. The control system includes a pair of cameras 102, a control unit 106, and a linear encoder 108. In the following, it is assumed that only one of the drive motors 50 is provided for the convenience's sake. The other drive motor 50 is controlled similarly. The control unit 106 processes pictures taken by the cameras 102 to control the drive motor 50. The linear encoder 108 detects the amount of movement of the nut 54 in the Y-axis direction.

Figure 7A:
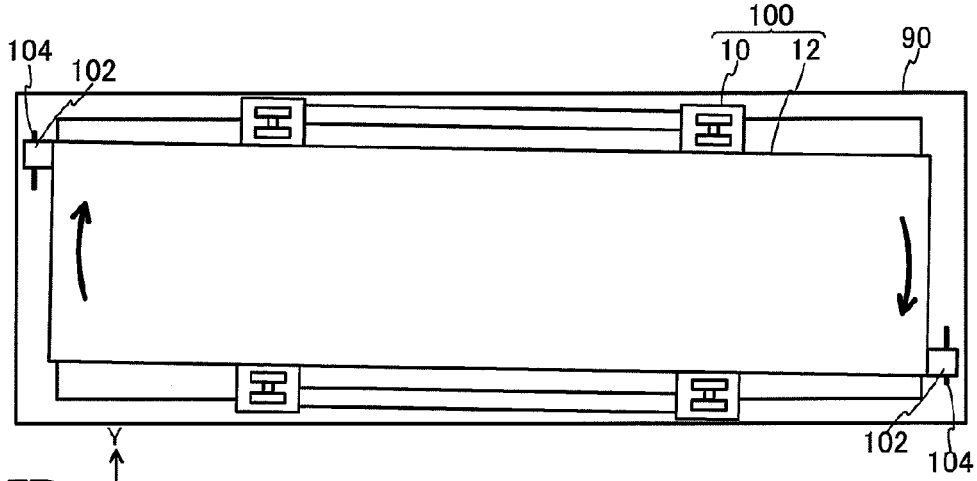
FIGS. 7A through 7C illustrate cameras and markers for detecting the orthogonality of the rotary unit.
Figure 7B:
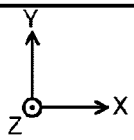
Figure 7B:
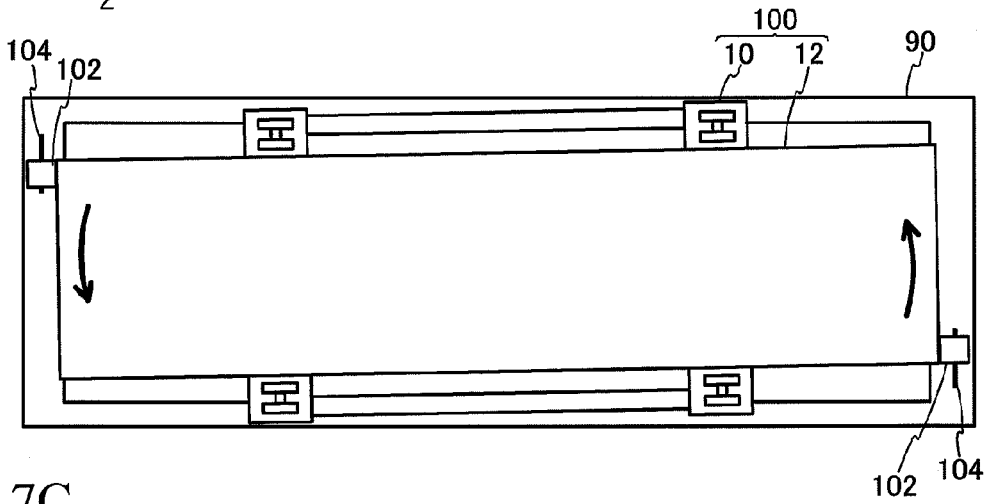
Figure 7C:
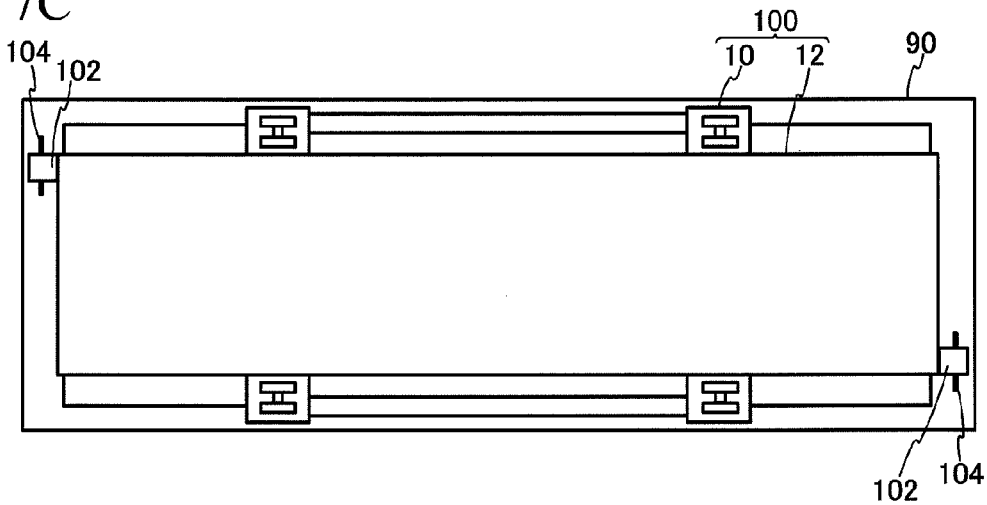
Figure 8A:
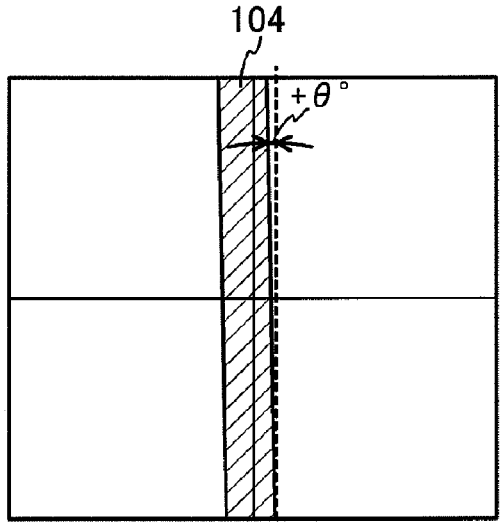
FIGS. 8A through 8C illustrate exemplary images taken by the cameras.
Figure 8B:
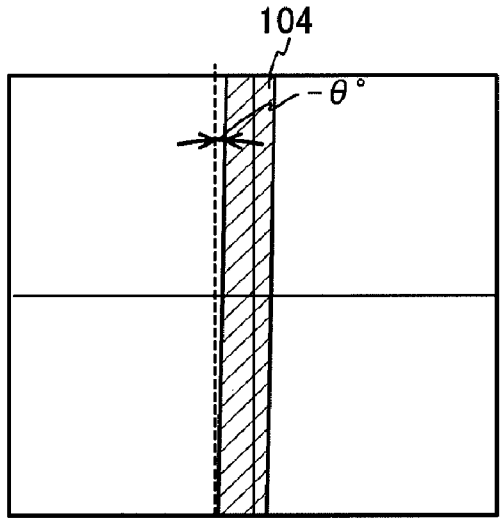
Figure 8C:
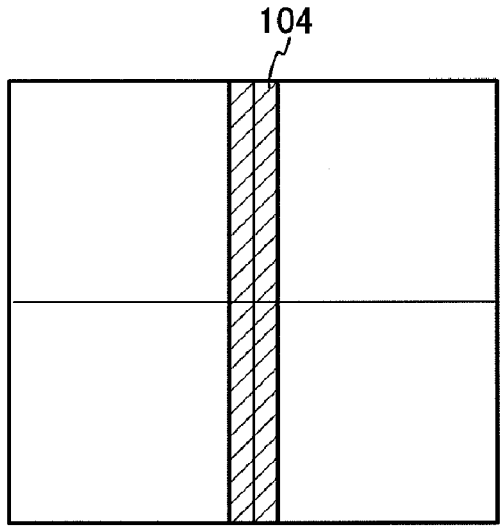

As illustrated in FIG. 7A, one of the two cameras 102 is placed in the proximity of one of the corners of the rotary unit 12 on the −X and +Y sides thereof (more specifically, the base frame 20). The other camera 102 is placed in the proximity of the corner of the rotary unit 12 on the +X and −Y sides thereof. Further, a marker 104 for detecting the orthogonality of the rotary unit 12 is provided on the upper surface of the electrolytic bath 90 and is located in the proximity of the corner on the −X and +Y sides. Another marker 104 is provided on the upper surface of the electrolytic bath 90 and is located in the proximity of the corner on the +X and −Y sides. The markers 104 run in the Y-axis direction. Images of the markers 104 can be taken by the cameras 102 in the state in which the electrode plate transportation apparatus 100 is positioned in place above the electrolytic bath 90. FIGS. 8A through 8C illustrate exemplary images taken by the cameras 102.

Turning back to FIG. 6, the control unit 106 has an image processing part 112, a deviation angle calculation part 114, a corrected distance calculation part 116 and a drive motor control part 118.

The image processing part 112 processes the images taken by the pair of cameras 102. The deviation angle calculation part 114 calculates the angle of deviation of each marker 104 with respect to the coordinate (Y axis) of the camera 102 on the basis of the images processed by the image processing part 112. The deviation angle calculation part 114 may detect the boundary (edge) between the marker 104 and the background (the upper surface of the electrolytic bath 90) from the images taken by each of the cameras 102 (FIGS. 8A through 8C), and calculates the angle (relative angle) between the edge (boundary) and the coordinate of the camera 102 (Y axis). For example, as illustrated in FIG. 7A, there may be a case where the entire electrode plate transportation apparatus 100 rotates clockwise with respect to the electrolytic bath 90, the deviation angle calculation part 114 calculates the angle +θ° shown in FIG. 8A. For a case illustrated in FIG. 7B where the entire electrode plate transportation apparatus 100 rotates counterclockwise with respect to the electrolytic bath 90, the deviation angle calculation part 114 calculates the angle −θ° shown in FIG. 8B. For a case of FIG. 7C where the entire electrode plate transportation apparatus 100 is positioned at the correct angle, the deviation angle calculation part 114 calculates an angle of 0° because the edge of the marker 104 is aligned with the Y axis.

Figure 9:
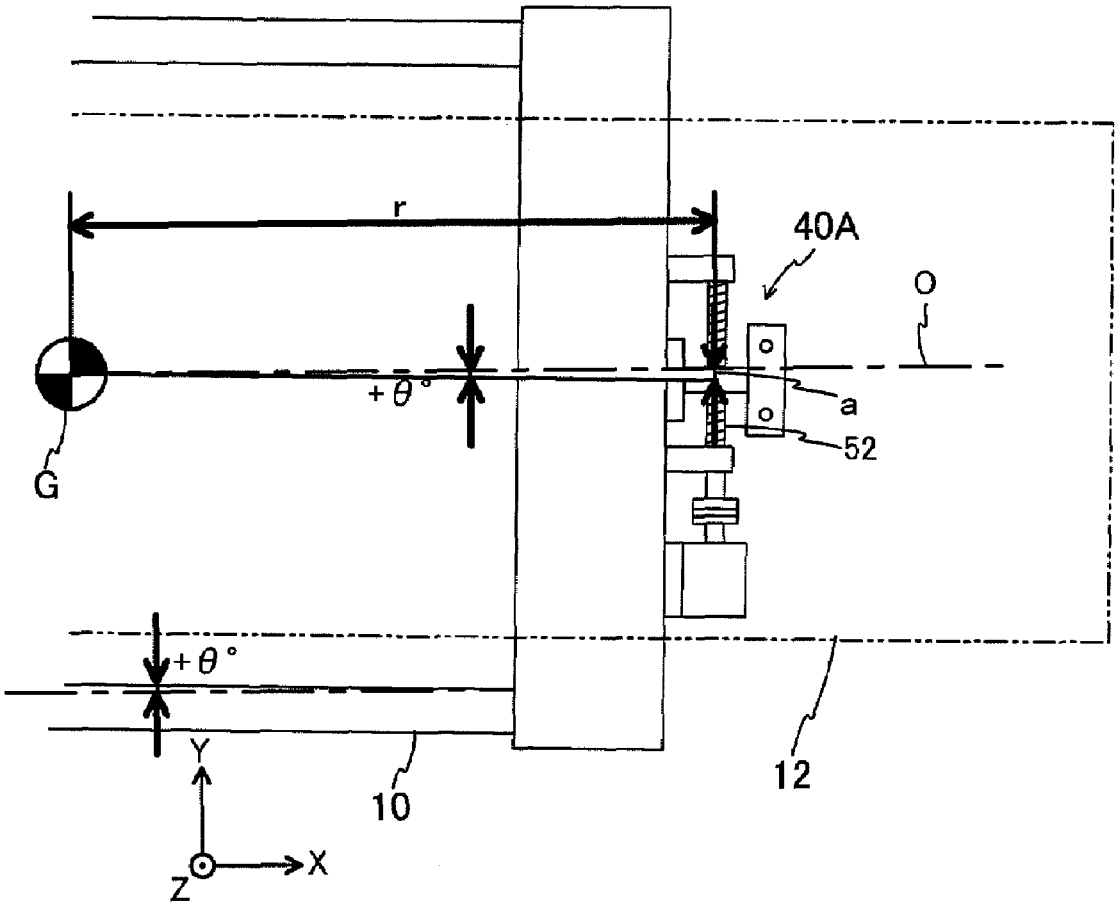
FIG. 9 illustrates a way to calculate a corrected distance.

Turning back to FIG. 6, the corrected distance calculation part 116 obtains a corrected distance on the basis of the angle calculated by the deviation angle calculation part 114. The corrected distance may be equal to the distance by which the nut 54 should be moved in the Y-axis direction for adjusting the angle. For example, when the deviation angle calculation part 114 calculates the angle +θ°, as illustrated in FIG. 9, the entire electrode plate transportation apparatus 100 is rotated and positioned at the angle +θ° that deviates from the reference angle O. Thus, assuming that the distance to the screw 52 from the center of gravity G is r, the corrected distance a of the nut 54 is obtained by expression (1):

$$a = r \cdot (+\theta) \tag{1}$$

Turning back to FIG. 6, the drive motor control part 118 controls the revolution of the motor 50 so as to move the nut 54 in the Y-axis direction by the corrected distance a (absolute value of a) obtained by the corrected distance calculation part 116. In the rotation drive mechanism 40A illustrated in FIG. 9 the nut 54 is moved in the +Y direction. In the rotation drive mechanism 40B, the nut 54 is moved in the −Y direction. The drive motor control part 118 monitors the moving distance of the nut 54 by using the linear encoder 108 in order to control the revolution of the drive motor 50. The linear encoder 108 may be composed of a linear scale and an encoder main body that is composed of a light-emitting part and a light-receiving part. The linear scale extends in the Y-axis direction. The light-emitting part projects light onto the linear scale, and the light-receiving part receives the light through the linear scale.

When the deviation angle calculation part 114 calculates the angle $-\theta°$, the corrected distance calculation part 116 results in $a=r\cdot(-\theta)$, the drive motor control part 118 controls the revolution of the motor 50 so as to move the nut 54 in the Y-axis direction by the corrected distance a (absolute value of a) obtained by the corrected distance calculation part 116. In the rotation drive mechanism 40A illustrated in FIG. 9 the nut 54 is moved in the −Y direction. In the rotation drive mechanism 40B, the nut 54 is moved in the +Y direction.

The cameras 102, the markers 104, the image processing part 112, and the deviation angle calculation part 114 form a detection unit. The corrected distance calculation part 116, the drive motor control part 118 and the linear encoder 108 form a drive control unit.

As described above, according to the second embodiment, the deviation angle calculation part 114 calculates the angle of deviation from the images taken by the pair of cameras 102, and the corrected distance calculation part 116 calculates the corrected distance a from the angle of deviation by using expression (1). The drive motor control unit 118 controls the drive motor 50 on the basis of the corrected distance a and the output of the linear encoder 108 (the moving distance of the nut 54). The second embodiment always or constantly executes the above-mentioned control to automatically correct the swing and/or attitude variation of the electrode plate transportation apparatus 100.

The above-described linear encoder 108 may be replace with a rotary encoder that detects revolution of the drive motor 50. In this case, the number of revolutions is associated with the corrected distance a in the corrected distance conversion part 116.

The makers 104 may be aligned in the X-axis direction. The markers 104 may have a cross shape.

Only one camera 102 and only one marker 104 may be used. Three or more cameras 102 and three or more markers 104 may be used.

The present invention is not limited to the specifically disclosed embodiments, but other embodiments and variations may be made without departing from the scope of the present invention.

What is claimed is:

1. An electrode plate transportation apparatus that lifts and lowers electrode plates moved to a position above an electrolytic bath and places and draw the electrode plates in and from the electrolytic bath, comprising:

a stationary frame that is suspended from an upper position in a vertical direction;

a rotary unit that is composed of hold members for holding the electrode plates in a suspended state and is held so as to rotate in a rotational direction about the vertical direction by the stationary frame; and a drive mechanism that is provided between the stationary frame and the rotary unit and applies drive force along an one-axis direction in a plane perpendicular to the vertical direction to the rotary unit to thus drive the rotary unit in the rotational direction and adjust the attitudes of the electrode plates that are held by the hold members against the electrolytic bath with respect to the rotational direction, wherein the rotary unit includes:

a rotary frame that is provided above the stationary frame and the drive mechanism and is rotated about the vertical direction in response to the drive force by the drive mechanism;

a base frame that is provided below the stationary frame and supports the hold members; and joint members that join the rotary frame and the base frame.

2. The electrode plate transportation apparatus as claimed in claim 1, further comprising:

a motor attached to the stationary frame;

a screw that is attached to a rotary shaft and extends in the one-axis direction;

a nut engaged with the screw; and a transfer member that transfers driving force of the nut that is moved along the rotary shaft of the motor by rotation of the screw to a position that is offset from a center of gravity of the rotary unit in the plane in a direction crossing the one-axis direction.

3. The electrode plate transportation apparatus as claimed in claim 2, further comprising an overload protection mechanism that prevents driving force of the motor from being transferred to the screw when a load exceeding a threshold level is applied.

4. The electrode plate transportation apparatus as claimed in claim 1, further comprising another driving mechanism that is paired with said driving mechanism and is symmetrical with said driving mechanism about a center of gravity of the stationary frame, wherein said another driving mechanism has a configuration identical to that of said driving mechanism.

5. The electrode plate transportation apparatus as claimed in claim 1, further comprising a guide mechanism that is provided between the stationary frame and the rotary unit and guides the rotary unit in the rotational direction about the vertical direction.

6. The electrode plate transportation apparatus as claimed in claim 5, wherein the guide mechanism includes:

a guide member that is fixed to the stationary frame and is formed in an arc shape; and a slider member that is fixed to the rotary unit and slide on the guide member.

7. The electrode plate transportation apparatus as claimed in claim 6, wherein the guide mechanism has a stopper that limits a range of movement of the slider member.

8. The electrode plate transportation apparatus as claimed in claim 1, further comprising:

a detecting part that detects a relative angle between the rotary unit and the electrolytic bath; and a drive control part that controls the drive mechanism on the basis of the relative angle detected by the detecting part to thus drive the rotary unit in the rotational direction.

9. The electrode plate transportation apparatus as claimed in claim 8, wherein the detecting part includes:

a marker that indicates an angle of the electrolytic bath;

an image taking part that is attached to the rotary unit and takes an image of the marker; and a calculation part that calculates the relative angle on the basis of the image of the maker taken by the image taking part.

* * * * *